US006875069B2

(12) United States Patent
Araki et al.

(10) Patent No.: US 6,875,069 B2
(45) Date of Patent: Apr. 5, 2005

(54) AIR-INTAKE SYSTEM OF MULTI-CYLINDER ENGINE OF SMALL WATERCRAFT

(75) Inventors: Toshio Araki, Kakogawa (JP); Masaaki Miyoshi, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/624,369

(22) Filed: Jul. 21, 2003

(65) Prior Publication Data

US 2004/0053544 A1 Mar. 18, 2004

(30) Foreign Application Priority Data

Jul. 23, 2002 (JP) ..... 2002-214212

(51) Int. Cl.[7] ..... B63H 21/10

(52) U.S. Cl. ..... 440/88 A

(58) Field of Search ..... 440/88 A, 88 R

(56) References Cited

U.S. PATENT DOCUMENTS 6,447,351 B1 * 9/2002 Nanami ..... 440/88 R

* cited by examiner

*Primary Examiner*—Ed Swinehart

(74) *Attorney, Agent, or Firm*—Alleman Hall McCoy Russell & Tuttle LLP

(57) ABSTRACT

An air-intake system of a multi-cylinder engine of a small watercraft. The system typically includes a plurality of air-intake pipes respectively provided for cylinders, the air-intake pipes having first opening end portions respectively connected to a plurality of air-intake ports of a cylinder head, and an air-intake box to which second opening end portions of the air-intake pipes are connected. The air-intake box typically is provided laterally of the engine and has a bottom portion located lower than a center axis of a crankshaft of the engine, and the air-intake pipes typically extend from the air-intake ports to an inside of the air-intake box. The second opening end portions typically open inside the air-intake box at a position spaced apart a predetermined distance from an inner bottom face of the bottom portion of the air intake box.

12 Claims, 5 Drawing Sheets

AIR-INTAKE SYSTEM OF MULTI-CYLINDER ENGINE OF SMALL WATERCRAFT

BACKGROUND OF THE INVENTION

1. Field of the Invention

The present invention relates to an air-intake system of a multi-cylinder engine mounted in a small watercraft such as a personal watercraft.

2. Description of the Related Art

An engine body mainly comprises a cylinder head on the upper side, a cylinder block located below the cylinder head, and a crankcase located below the cylinder block. The inline multi-cylinder engine is substantially flask-shaped, as seen in a cross-sectional view of the engine when sectioned in the direction perpendicular to the longitudinal direction of the crankshaft. The cylinder block has a width smaller than that of the crankcase.

In general, an air-intake system of the multi-cylinder engine mounted in the small watercraft is configured to have an ambient-air inlet, an air cleaner for cleaning ambient air taken in from outside through the inlet, a throttle body for adjusting an air-intake amount, an air-intake box having a certain volume to temporarily store the air (sometimes omitted), and an air-intake pipe serving as a passage through which air is delivered into an air-intake port of the cylinder head. In this air-intake system, these components are connected in this order.

When the air-intake box is contained in a relatively limited inner space of the small watercraft, it is typically located laterally of the cylinder block having a small width.

Engine power is influenced by various factors. One factor is volumetric efficiency. As used herein, the volumetric efficiency refers to a ratio of the volume of air actually drawn into the cylinder to the displacement of the engine. The engine power is increased by improving the volumetric efficiency, i.e., by increasing the amount of air actually drawn into the cylinder during an operation of the engine (hereinafter referred to as an "air-intake amount".)

Especially in the engine mounted in the small watercraft which is required to have a small size and a light weight, in order to generate high power with small displacement of the engine, it is desired that the power be increased by increasing the volumetric efficiency of the air to be drawn into the cylinder.

The volumetric efficiency (air-intake ability) can be improved by designing a structure of the air intake-pipe or the like through which air is drawn into the cylinder of the engine in view of air-intake inertia and pulsation effects. That is, if the engine speed required to generate high power is determined, an optimum length of the air-intake pipe may be determined.

Specifically, in the case of the engine required to generate high power during relatively high-speed rotation, the length of the air-intake pipe is preferably set relatively short. On the other hand, in the case of the engine required to generate high power during relatively low-speed rotation, the length of the air-intake pipe is preferably set relatively long. In this manner, the air-intake ability can be improved by designing the air-intake pipe or the like according to the optimum wavelength of the pulsation flow determined by the engine speed.

Commonly, a longer air-intake pipe is used in engines mounted in small watercraft required to generate high power during relatively low-speed rotation. However, in multi-cylinder engines mounted in small watercraft, the air-intake box is located laterally of the cylinder block and close to the air-intake port, therefore the air-intake pipe connecting the air-intake ports to the air-intake box is difficult to extend.

SUMMARY OF THE INVENTION

The present invention addresses the above-described conditions, and an object of the present invention is to provide an air-intake system provided with an air-intake pipe having a proper length in a multi-cylinder engine mounted in the small watercraft.

According to the present invention, there is provided an air-intake system of a multi-cylinder engine of a small watercraft, comprising a plurality of air-intake pipes respectively provided for cylinders, the air-intake pipes having first opening end portions respectively connected to a plurality of air-intake ports of a cylinder head; and an air-intake box to which second opening end portions of the air-intake pipes are connected, wherein the air-intake box is placed laterally of the engine and has a bottom portion located lower than a center axis of a crankshaft of the engine, and the air-intake pipes extend from the air-intake ports to an inside of the air-intake box, and the second opening end portions open inside the air-intake box at a position spaced apart at a predetermined distance from an inner bottom face of the bottom portion of the air intake box.

In this structure, since the bottom portion of the air-intake box is located to be relatively distant from the air-intake ports, the second opening end portions of the air-intake pipes can be extended to a vicinity of the inner bottom face of the bottom portion of the air-intake box. Thereby, the air-intake pipes can gain sufficient length.

Preferably, in the air-intake system, the predetermined distance may be substantially not less than an inner diameter of the second opening end portions of the air-intake pipes and may be not more than substantially three times as large as the inner diameter.

In this structure, a desirable length of air-intake pipes for the engine of the small watercraft is obtained. In addition, an increase in an air-intake resistance is controlled.

Preferably, in the air-intake system, the second opening end portions of the air-intake pipes may extend downwardly inside the air-intake box through an upper portion of the air-intake box, and at least a portion of each of the air-intake pipes inside the air-intake box may have a substantially straight pipe shape.

The air-intake resistance increases with an increase in a longitudinal curvature of the air-intake pipe. Therefore, with the above structure, the air-intake resistance in the straight-pipe portion can be reduced and, consequently, the air-intake ability is improved.

Preferably, in the air-intake system, the second opening end portions of the air-intake pipes may be arranged to be close to one another.

Typically, the air-intake pipes provided in the conventional multi-cylinder engine are arranged to extend from the air-intake ports to the air-intake box and to have equal spacing between adjacent pipes. By making the second opening end portions of the air-intake pipes close to one another, as described above, the air-intake system of a small size is gained. So, even in the engine mounted in a boat having a limited inner space, such as the small watercraft, the air-intake pipes can be relatively long.

Preferably, in the air-intake system, the second opening end portions of the air-intake pipes may open toward substantially the same direction, and the second opening end portions of the air-intake pipes into which air is drawn in successive order may be formed to have different predetermined distances from the inner bottom face of the bottom portion so as to be located at different positions in a direction in which the second opening end portions open.

In the air-intake pipes having openings close to one another, air currents flowing through the respective openings interfere with one another, which inhibits smooth airflow. However, in the system, interference of air generated in the vicinity of the second opening end portions can be inhibited, thereby resulting in an improved air-intake ability.

Preferably, in the air-intake system, the air-intake pipes may have an equal length. By setting the air-intake pipes to have an equal length, the air-intake pipes have similar air-intake characteristic.

Preferably, in the air-intake system, the air-intake pipes and the air-intake box may be integrally molded. For example, the air-intake pipes and the air-intake box are integrally cast using aluminum.

In this structure, since the air-intake pipes having the second opening end portions located at different positions in the direction in which the opening end portions open can be integrally molded, burdensome work such as welding the second opening end portions of individual air-intake pipes to be located at different positions becomes unnecessary, and the air-intake pipes having the second opening end portions located at different positions with high precision can be easily molded.

According to the present invention, there is further provided an air-intake system of a multi-cylinder engine of a small watercraft, comprising a plurality of air-intake pipes respectively provided for cylinders, the air-intake pipes having first opening end portions respectively connected to a plurality of air-intake ports of a cylinder head; and an air-intake box to which second opening end portions of the air-intake pipes are connected, wherein the air-intake pipes extend from the air-intake ports to the inside of the air-intake box, the second opening end portions of the air-intake pipes open inside the air-intake box toward substantially the same direction, and the second opening end portions of the air-intake pipes into which air is drawn in successive order are formed to have different predetermined distances from an inner bottom face of a bottom portion of the air-intake box so as to be located at different positions in a direction in which the second opening end portions open.

In this structure, the length of the air-intake pipes can be made relatively longer. In addition, the air-intake interference is inhibited, and the air-intake ability is thereby improved.

Preferably, in the air-intake system, the air-intake pipes may have an equal length.

Preferably, in the air-intake system, the second opening end portions of the air-intake pipes may be arranged to be close to one another.

Preferably, in the air-intake system, the air-intake box may be placed laterally of the engine and may be configured to have a bottom portion located lower than a center axis of a crankshaft of the engine.

The above and further objects and features of the invention will more fully be apparent from the following detailed description with accompanying drawings.

DETAILED DESCRIPTION OF THE PREFERRED EMBODIMENTS

Figure 1:
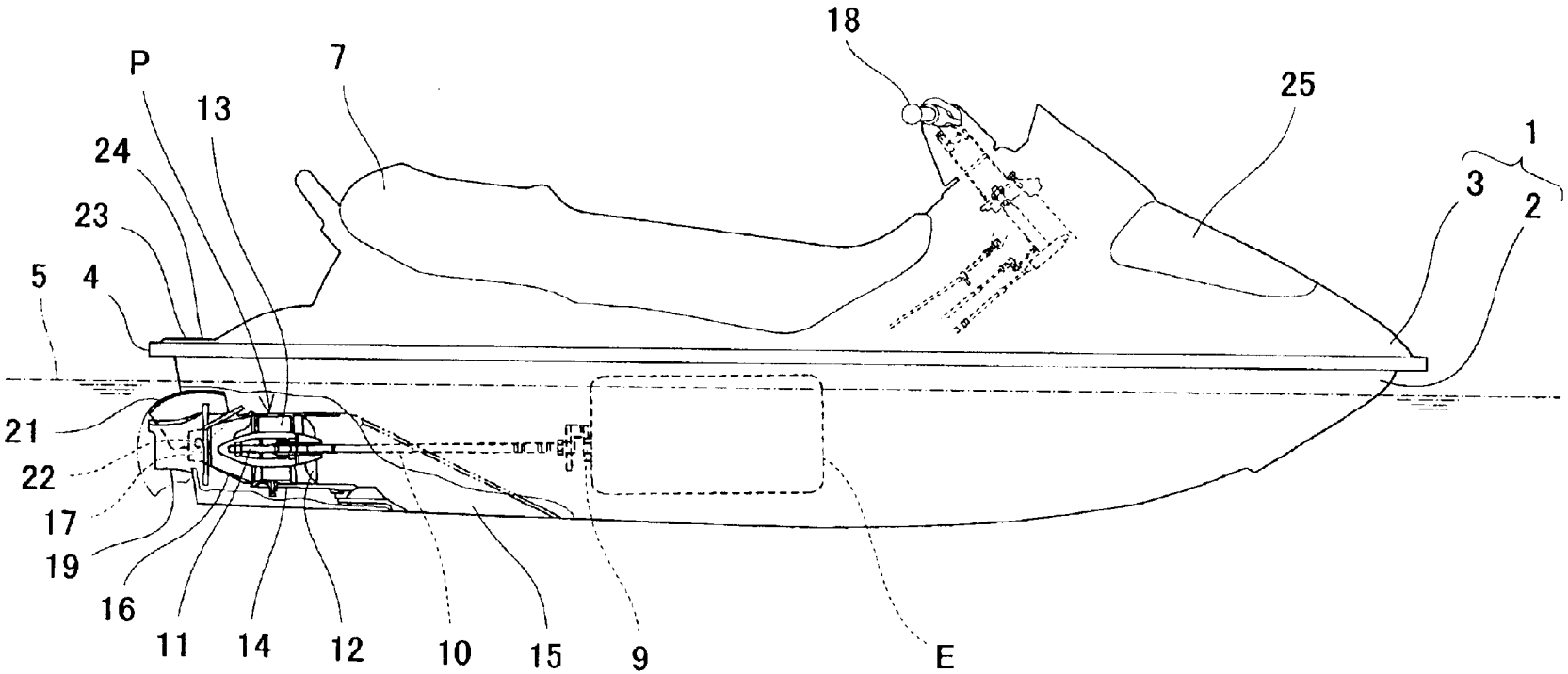
FIG. 1 is a side view of a personal watercraft in which a multi-cylinder engine having an air-intake system according to an embodiment of the present invention is mounted.

Hereinafter, an embodiment of an air-intake system of a multi-cylinder engine of a small watercraft of the present invention will be described with reference to the accompanying drawings. In the watercraft in FIG. 1, a body 1 of the watercraft comprises a hull 2 and a deck 3 covering the hull 2 from above. A line at which the hull 2 and the deck 3 are connected over the entire perimeter thereof is called a gunnel line 4. The gunnel line 4 is located above a waterline 5 of the watercraft.

Figure 2:
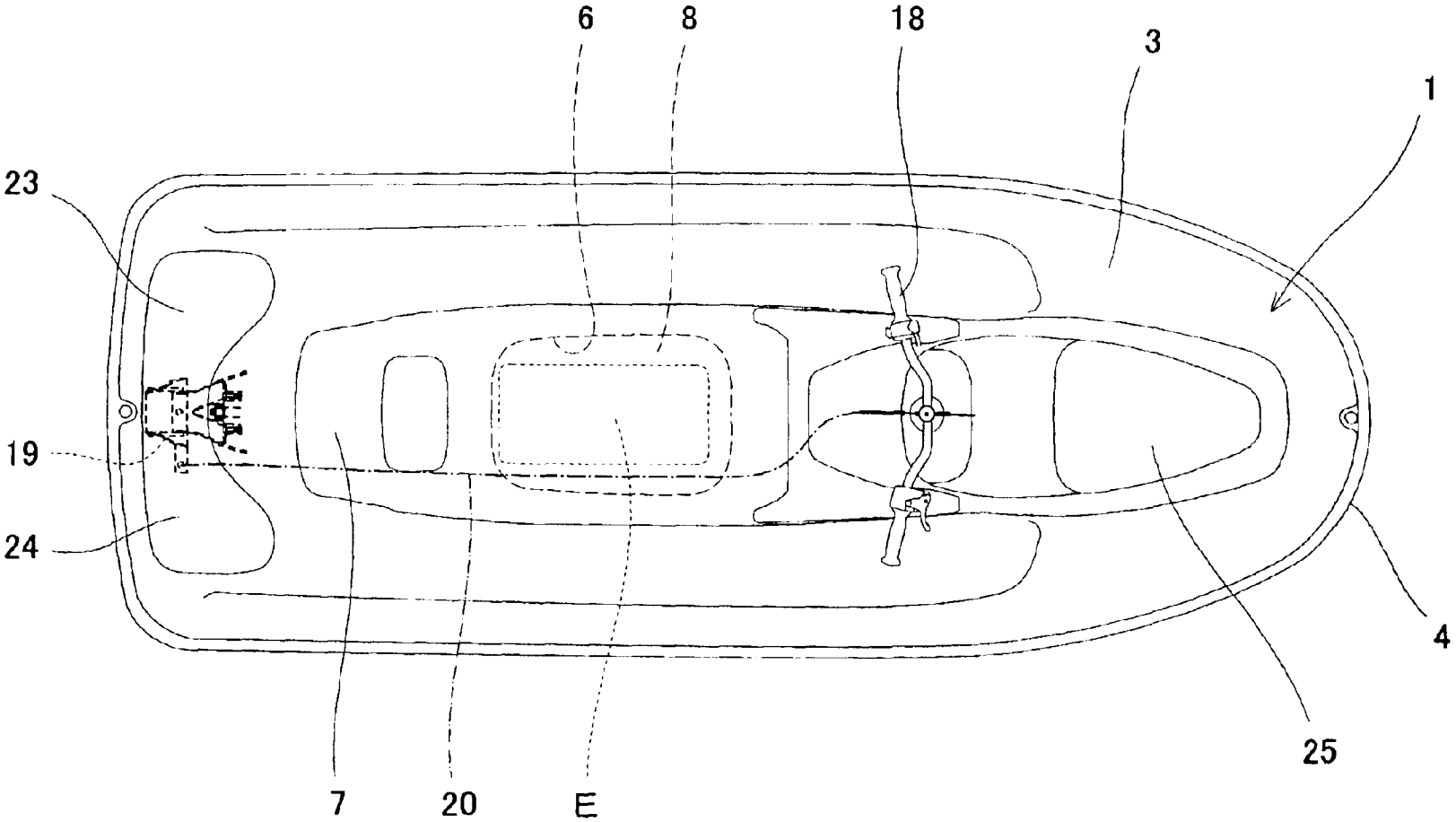
FIG. 2 is a plan view of the personal watercraft in FIG. 1.

As shown in FIG. 2, a deck opening 6, which has a substantially rectangular shape as seen from above is formed at a substantially center section of the deck 3 in the upper portion of the body 1 such that its longitudinal direction corresponds to the longitudinal direction of the body 1. A seat 7 is removably mounted over the deck opening 6.

An engine room 8 is provided in a space defined by the hull 2 and the deck 3 below the deck opening 6. An engine E is mounted in the engine room 8. In this embodiment, the engine E is an inline four-cylinder four-cycle engine. As shown in FIG. 1, the engine E is mounted such that a crankshaft 9 is placed along the longitudinal direction of the body 1.

An output end of the crankshaft 9 is rotatably coupled integrally with a pump shaft 11 of a water jet pump P provided on the rear side of the body 1 through a propeller shaft 10. An impeller 12 is attached on the pump shaft 11. Fairing vanes 13 are provided behind the impeller 12. The impeller 12 is covered with a tubular pump casing 14 on the outer periphery thereof.

A water intake 15 is provided on the bottom of the body 1. The water intake 15 is connected to the pump casing 14 through a water passage. A pump nozzle 16 is provided on the rear side of the pump casing 14. The pump nozzle 16 has a cross-sectional area that is gradually reduced rearward, and an outlet port 17 is provided on the rear end of the pump nozzle 16.

The water outside the watercraft is sucked from the water intake 15 and fed to the water jet pump P. The water jet pump P pressurizes and accelerates the water and the fairing vanes 13 fair water flow behind the impeller 12. The water is ejected through the pump nozzle 16 and from the outlet port 17, and as the resulting reaction, the watercraft obtains a propulsion force.

In FIGS. 1 and 2, reference numeral 18 denotes a bar-type steering handle. The steering handle 18 is connected to a steering nozzle 19 provided behind the pump nozzle 16 through a cable 20 (see FIG. 2). When the rider rotates the handle 18 clockwise or counterclockwise, the steering nozzle 19 is swung toward the opposite direction so that the ejection direction of the water being ejected through the pump nozzle 16 can be changed, and the watercraft can be correspondingly turned to any desired direction while the water jet pump P is generating the propulsion force.

As shown in FIG. 1, a bowl-shaped reverse deflector 21 is provided on the rear side of the body 1 to position the steering nozzle 19 inside the deflector 21 such that it can vertically swing around a horizontally mounted swinging shaft 22. The deflector 21 is swung downward to a lower position around the swinging shaft 22 to deflect the ejected water from the steering nozzle 19 forward and, as the resulting reaction, the personal watercraft moves rearward.

In FIGS. 1 and 2, a rear deck 23 is provided in the rear section of the body 1. The rear deck 23 is provided with an openable rear hatch cover 24. A rear compartment (not shown) with a small capacity is provided under the rear hatch cover 24. In FIGS. 1 and 2, a front hatch cover 25 is provided in a front section of the body 1. A front compartment (not shown) is provided under the front hatch cover 25 for storing equipments and the like.

Subsequently, an air-intake system of the engine E mounted in the personal watercraft will be described. Here, the direction relating to the engine E corresponds with the direction (longitudinal, lateral, and vertical directions) relating to the personal watercraft with the engine E mounted in the personal watercraft as shown in FIG. 1.

Figure 3:
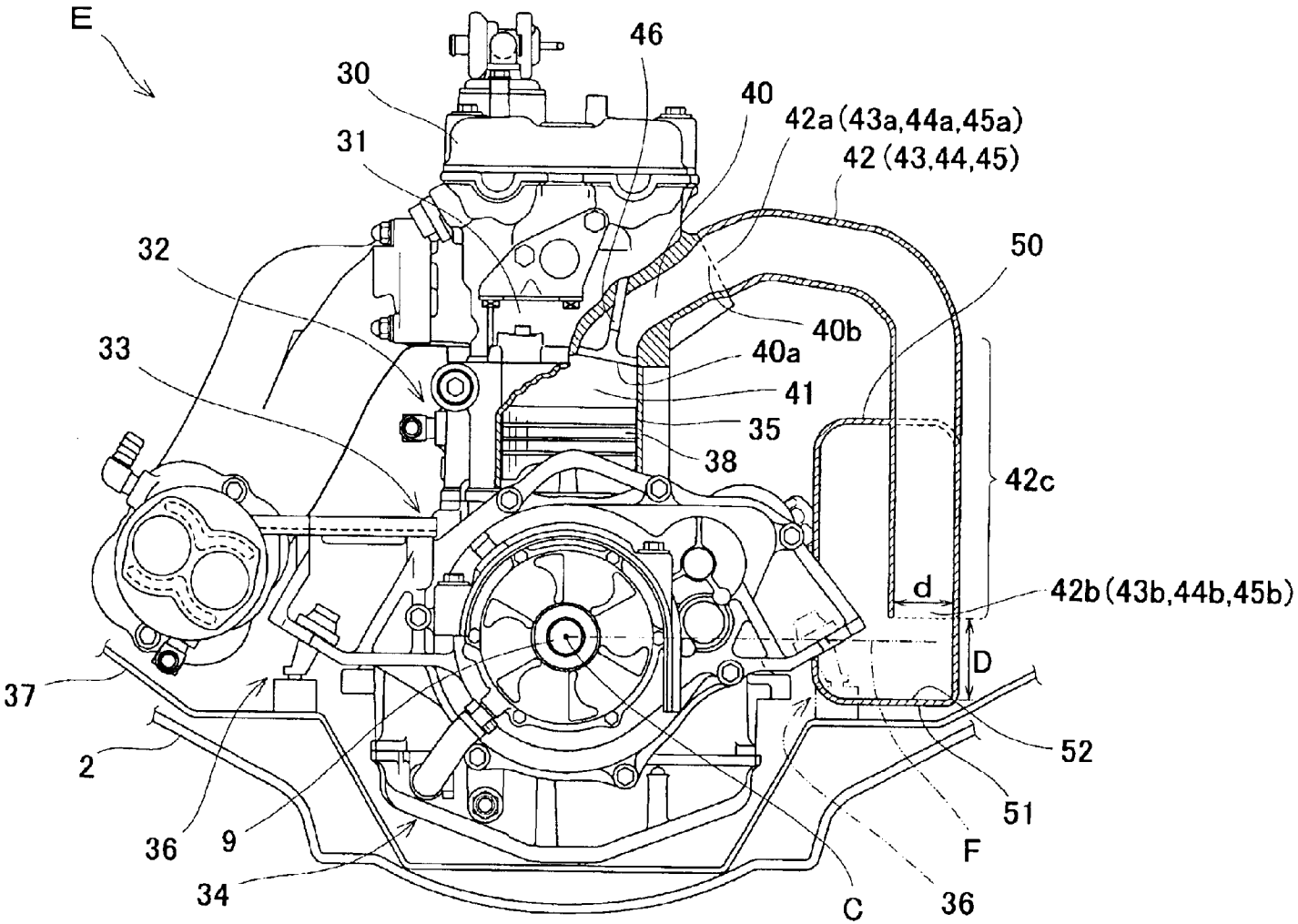
FIG. 3 is a partial cross-sectional view showing an engine as seen from behind.

As shown in FIG. 3, a body of the engine E mainly comprises a cylinder head 31 covered by a cylinder head cover 30 from above, a cylinder block 32 located under the cylinder head 31, a crankcase 33 located under the cylinder block 32, and an oil pan 34 located under the crankcase 33.

Figure 4:
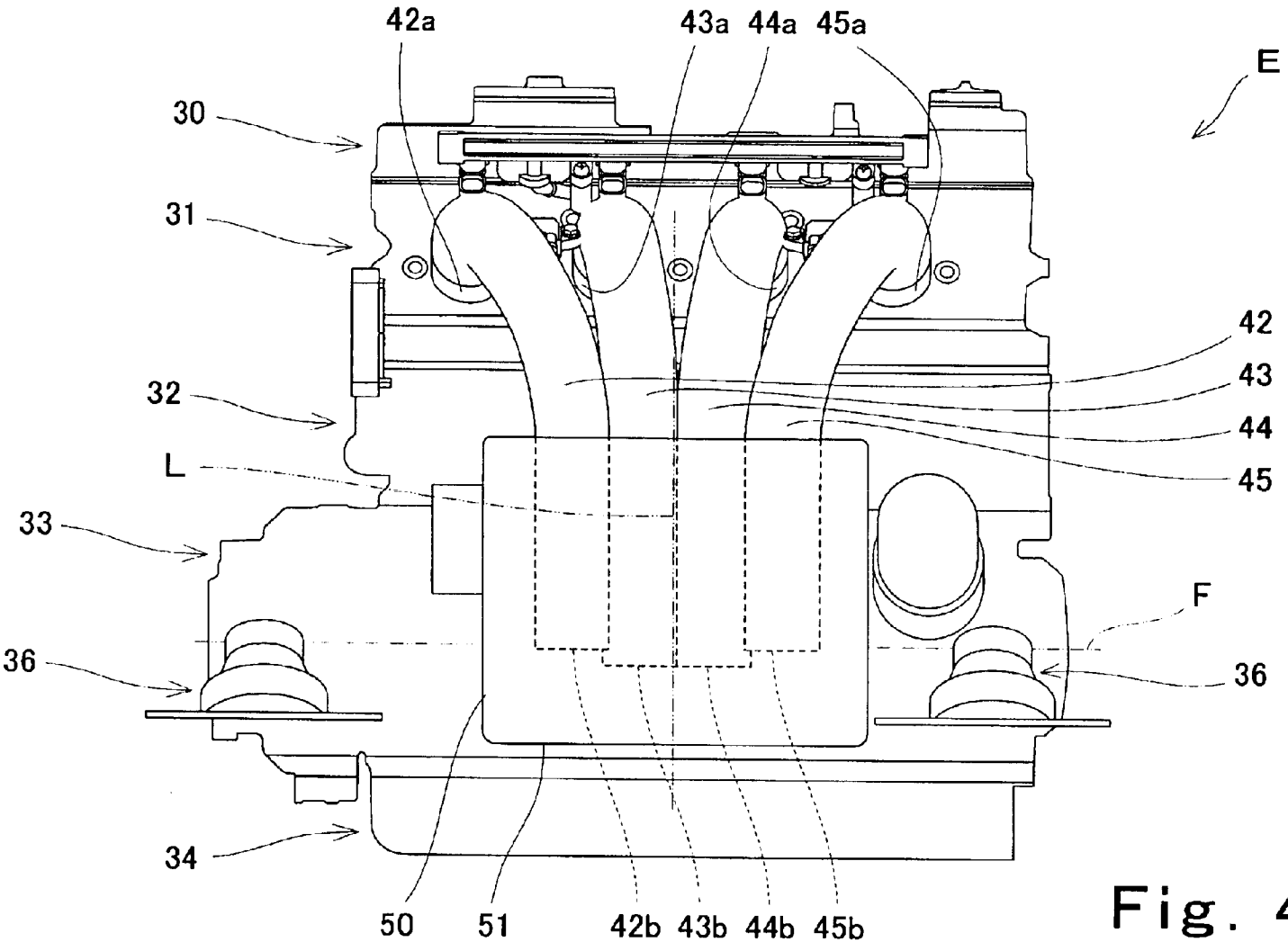
FIG. 4 is a side view showing an engine as seen from the right side.

As described above, the engine E is an inline four-cylinder engine. Inside the cylinder block 32, four cylinders 35 are arranged along the longitudinal direction. As shown in FIGS. 3 and 4, engine mounts 36 are provided on both side portions of the crankcase 33 on the front and rear sides in the longitudinal direction. The engine E is fixed to an inner hull 37 provided inside the hull 2 through the engine mounts 36. The engine E is installed in the engine room such that a piston 38 inside the cylinder 35 strokes substantially vertically, i.e., the cylinder 35 extends substantially vertically.

Inside the cylinder head 31, four integrally molded air-intake ports 40 are respectively provided for the four cylinders 35. One opening end portions (hereinafter referred to as "inner-side opening end portions") 40*a* of the air-intake ports 40 communicate with upper portions of combustion chambers 41 provided on the cylinders 35 inside the cylinder block 32, and the other opening end portions (hereinafter referred to as "outer-side opening end portions") 40*b* open obliquely rightwardly and outwardly in the upper portion of the cylinder head 31 and are connected to one opening end portions 42*a*, 43*a*, 44*a*, and 45*a* (hereinafter referred to as "downstream opening end portions") of air-intake pipes 42, 43, 44, and 45 (see FIG. 4) provided outside of the cylinder head 31.

The air-intake ports 40 allow the air-intake pipes 42 to 45 and the combustion chambers 41 located on the cylinders 35 to communicate with each other and thus form airflow passages. In the vicinity of the inner-side opening end portions 40*a* of the air-intake ports 40, air-intake valves 46 are respectively provided. The air-intake valves 46 are driven by rotation of a cam (not shown), thereby causing the inner-side opening end portions 40*a* to be opened and closed.

The air-intake pipe 42 extends laterally from the downstream opening end portion 42*a*. The air-intake pipe 42 is curved at a position thereof and then extends downwardly. The other opening end portion (hereinafter referred to as an "upstream opening end portion") 42*b* of the air-intake pipe 42 open inside an air-intake box 50 provided at a predetermined position on the right side of the engine E.

The air-intake pipes 43, 44 and 45 are configured in the same manner as the air-intake pipe 42. The air-intake pipes 43, 44 and 45 extend laterally from the downstream opening end portions 43*a*, 44*a*, and 45*a*. The air-intake pipes 43, 44, and 45 are curved at a position thereof and then extend downwardly. As shown in FIG. 4, the other opening end portions (hereinafter referred to as "upstream opening end portions") 43*b*, 44*b*, and 45*b* open inside the air-intake box 50.

The air-intake box 50 serves to temporarily store the air drawn from outside through an ambient-air inlet of an air cleaner (not shown) in an inner space having a certain volume and supply the air from the inner space into the air-intake pipes 42 to 45 to allow the air to be smoothly drawn into the air-intake pipes 42 to 45. Hereinafter, structures of the air-intake pipes 42 to 45 and the air-intake box 50 will be described in detail.

As shown in FIGS. 3 and 4, the air-intake box 50 has a substantially rectangular parallelepiped shape. The air-intake box 50 is provided laterally of the crankcase 33 and between the engine mounts 36 at front and rear positions on the right side of the engine E. The air-intake box 50 is configured to have a bottom portion 51 located closer to a bottom of the watercraft than a plane F (represented by two-dotted line in FIGS. 3 and 4) perpendicular to the direction in which the piston 38 strokes, i.e., the direction in which the cylinder 35 extends, including a center axis C of the crankshaft 9 (see FIGS. 1 and 3). That is, the bottom portion 51 is located lower than the center axis C.

As already described with reference to FIG. 3, the air-intake pipe 42 laterally extends from the downstream opening end portion 42*a*. Then, the air-intake pipe 42 is curved at a position and then extends downwardly to the upstream opening end portion 42*b*. From the curved portion of the air-intake pipe 42 to the upstream opening end portion 42*b* forms a straight pipe portion 42*c* that is substantially straight in the longitudinal direction of the air-intake pipe 42.

The air-intake pipe 42 extends downwardly inside the air-intake box 50 through an upper portion of the air-intake box 50. An end portion of the straight-pipe portion 42*c*, i.e., the upstream opening end portion 42*b*, is located inside the air-intake box 50 such that the upstream opening end portion 42*b* is opposed to an inner bottom face 52 of the bottom portion 51 of the air-intake box 50. In this embodiment, the upstream opening end portion 42*b* is formed to be perpendicular to the center axis of the air-intake pipe 42, but may be formed to be non-perpendicular to the center axis. The upstream opening end portion 42*b* is located to be spaced apart from the inner bottom face 52 of the bottom portion 51 of the air-intake box 50 by a distance D that satisfies the following formula (1), based on an air-intake resistance.

$$d \leq D \leq 3d \quad (1)$$

where d: an inner diameter of the upstream opening end portion 42*b* and D: a distance between the upstream opening end portion 42*b* of the air-intake pipe 42 and the inner bottom face 52 of the air-intake box 50 that is opposed to an opening face of the upstream opening end portion 42*b*.

In this structure, the air-intake pipe 42 is extended inside the air-intake box 50 to a position lateral of the crankcase 33 so that the air-intake pipe 42 has a relatively long length, which is desirable to the engine mounted in the small watercraft. And, an increase in the air-intake resistance in the vicinity of the upstream opening end portion 42*b* is controlled. The air-intake pipes 43 to 45 (see FIG. 4) have structures similar to that of the air-intake pipe 42.

As shown in FIG. 4, the air-intake pipes 42 to 45 are configured such that two adjacent upstream opening end portions of the upstream opening end potions 42*b* to 45*b* are close to each other. More specifically, the air-intake pipes 42 to 45 are arranged in this order from the rear to the front of the engine E, and the downstream opening end portions 42*a* to 45*a* of the air-intake pipes 42 to 45 are connected to the air-intake ports 40 (see FIG. 3) to have predetermined spacing between adjacent opening end portions. The upstream opening end portions 42*b* to 45*b* are arranged to be close to an imaginary vertical line L (see FIG. 4) extending between the downstream opening end portions 43*a* and 44*a*. In brief, the downstream opening end portions 42*a* to 45*a* of the air-intake pipes 42 to 45 are arranged to have a predetermined spacing between adjacent opening end portions, while the upstream opening end portions 42*b* to 45*b* are arranged to be close to one another.

When the upstream opening end portions 42*b* to 45*b* of the air-intake pipes 42 to 45 having an equal length are configured to be close to one another as described above, the vertical positions of the upstream opening end portions of two air-intake pipes into which the air is drawn in the successive order, can be varied from each other. As a result, the upstream opening end portions 43*b* and 44*b* of the air-intake pipes 43 and 44 on the inner side, are closer to the inner bottom face 52 of the air-intake box 50 than the upstream opening end portions 42*b* and 45*b* of the air-intake pipes 42 and 45 on the outer side are.

In the air-intake pipes 42 to 45 so configured, for example, the air is drawn into the engine E in the order of the air-intake pipe 42, the air-intake pipe 43, the air-intake pipe 45, and the air-intake pipe 44. Thereby, while the air is drawn into the air-intake pipes 42 to 45, interference of airflow in the vicinity of the upstream opening end portions 42*b* to 45*b* is prevented, so that the air smoothly flows in the vicinity of the upstream opening end portions 42*b* to 45*b*.

In this embodiment, as shown in FIG. 4, the upstream opening end portions 42*b* to 45*b* are arranged to be close to an imaginary vertical line L (see FIG. 4) extending between the downstream opening end portions 43*a* and 44*a*. Alternatively, the upstream opening end portions 42*b* to 45*b* may be arranged to be close to an imaginary vertical line extending behind or in front of the line L extending between the downstream opening end portions 43*a* and 44*a*.

Figure 5:
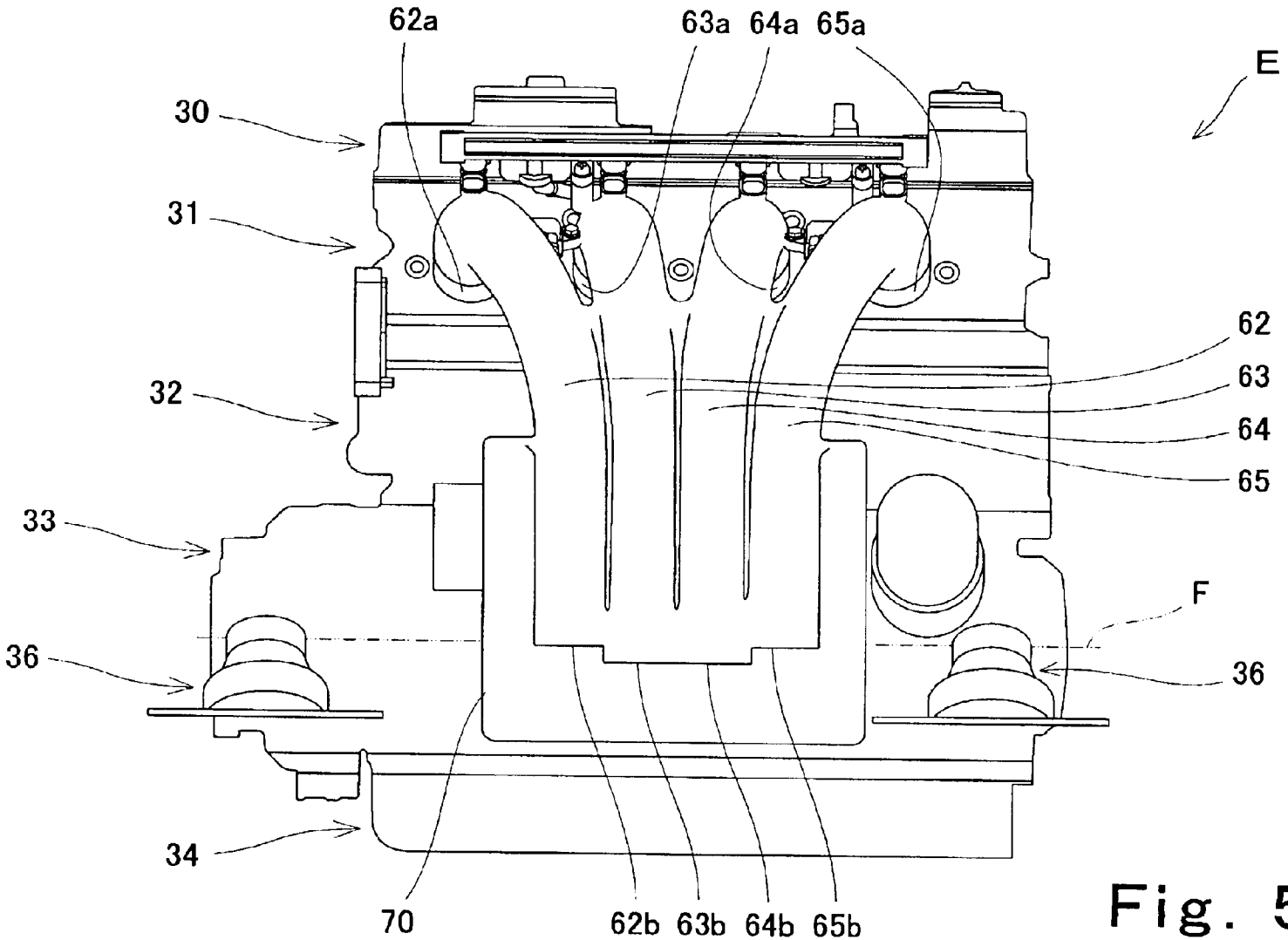
FIG. 5 is a side view of the engine having an air-intake system in which air-intake pipes and an air-intake box are integrally molded.

The air-intake pipes 42 to 45 may be integrally cast, or the air-intake pipes 42 to 45 and the air-intake box 50 may be integrally molded. FIG. 5 is a side view of the engine provided with the air-intake pipes and the air-intake box which are integrally cast. In the air-intake system in FIG. 5, air-intake pipes 62 to 65 respectively corresponding to the air-intake pipes 42 to 45 in FIG. 4 and an air-intake box 70 corresponding to the air-intake box 50 in FIG. 4 are integrally cast using aluminum.

In this structure, as the four air-intake pipes 62 to 65 with the upstream opening end portions 62*b* to 65*b* located at different positions in the direction in which the opening end portions open, are molded simultaneously, work such as welding the upstream opening end portions 62*b* to 65*b* to be located at different positions, becomes unnecessary, and the difference in dimension between the upstream opening end portions 62*b* to 65*b* is made with high precision.

The air-intake system of the engine of the present invention is applicable to an engine configured to have a vertically inclined cylinder.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An air-intake system of a multi-cylinder engine of a small watercraft, comprising:

a plurality of air-intake pipes respectively provided for cylinders, the air-intake pipes having first opening end portions respectively connected to a plurality of air-intake ports of a cylinder head; and an air-intake box to which second opening end portions of the air-intake pipes are connected, wherein the air-intake box is placed laterally of the engine and has a bottom portion located lower than a center axis of a crankshaft of the engine, and wherein the air-intake pipes extend from the air-intake ports to an inside of the air-intake box and the second opening end portions open inside the air-intake box at a position spaced apart a predetermined distance from an inner bottom face of the bottom portion of the air intake box, and the air-intake pipes are arranged such that a distance between respective central axes of the second opening end portions is smaller than a distance between respective central axes of the first opening end portions.

2. The air-intake system of a multi-cylinder engine of a small watercraft according to claim 1, wherein the predetermined distance is substantially not less than an inner diameter of the second opening end portions of the air-intake pipes and is not more than substantially three times as large as the inner diameter.

3. The air-intake system of a multi-cylinder engine of a small watercraft according to claim 2, wherein the second opening end portions of the air-intake pipes extend downwardly inside the air-intake box through an upper portion of the air-intake box, and at least a portion of each of the air-intake pipes inside the air-intake box has a substantially straight pipe shape.

4. The air-intake system of a multi-cylinder engine of a small watercraft according to claim 1, wherein the air-intake pipes are integral with the air-intake box.

5. The air-intake system of a multi-cylinder engine of a small watercraft according to claim 1, wherein the second opening end portions of the air-intake pipes open toward substantially the same direction, and the second opening end portions of two adjacent air-intake pipes into which air is drawn in successive order are located at different positions in a flow direction of the air within the second opening end portions.

6. The air-intake system of a multi-cylinder engine of a small watercraft according to claim 5, wherein the air-intake pipes have an equal length.

7. An air-intake system of a multi-cylinder engine of a small watercraft, comprising:

a plurality of air-intake pipes respectively provided for cylinders, the air-intake pipes having first opening end portions respectively connected to a plurality of air-intake ports of a cylinder head; and an air-intake box to which second opening end portions of the air-intake pipes are connected, wherein the air-intake pipes extend from the air-intake ports to an inside of the air-intake box, the second opening end portions of the air-intake pipes open inside the air-intake box toward substantially the same direction, and the second opening end portions of two adjacent air-intake pipes into which air is drawn in successive order are located at different positions in a flow direction of the air within the second opening end portions.

8. The air-intake system of a multi-cylinder engine of a small watercraft according to claim 7, wherein the air-intake pipes have an equal length.

9. The air-intake system of a multi-cylinder engine of a small watercraft, according to claim 8, wherein the air-intake pipes are arranged such that a distance between respective central axes of the second opening end portions is smaller than a distance between respective central axes of the first opening end portions.

10. The air-intake system of a multi-cylinder engine of a small watercraft according to claim 9, wherein the air-intake box is placed laterally of the engine and is configured to have a bottom portion located lower than a center axis of a crankshaft of the engine.

11. The air-intake system of a multi-cylinder engine of a small watercraft according to claim 10, wherein portions of the air-intake pipes which are located within the air-intake box are straight-line shaped and are in contact with each other.

12. The air-intake system of a multi-cylinder engine of a small watercraft according to claim 11, wherein the portions of the air-intake pipes are in contact with an inner wall of the air-intake box.

* * * * *